United States Patent [19]

Tilly

[11] Patent Number: 4,543,055

[45] Date of Patent: Sep. 24, 1985

[54] METHOD OF CONTROLLING THE FUEL SUPPLY AND BURNER FOR LIQUID FUEL

[75] Inventor: Adolphe J. G. Tilly, Hoofddorp, Netherlands

[73] Assignee: Conma, N.V., Willemstad, Netherlands Antilles

[21] Appl. No.: 567,513

[22] Filed: Jan. 3, 1984

[30] Foreign Application Priority Data

Jan. 5, 1983 [NL] Netherlands ..... 8300028

[51] Int. Cl.[4] ..... F23N 5/00

[52] U.S. Cl. ..... 431/12; 431/78; 431/86

[58] Field of Search ..... 431/12, 78, 80, 86

[56] References Cited

U.S. PATENT DOCUMENTS 4,125,357 11/1978 Kristen et al. ..... 431/78

*Primary Examiner*—Carroll B. Dority, Jr.

*Attorney, Agent, or Firm*—Diller, Ramik & Wight

[57] ABSTRACT

The liquid fuel is supplied to a burner through a control member, which is repeatedly energized with a set frequency for obtaining the desired temperature.

A deviation from an expected heat contents of the fuel is compensated by setting the energizing time.

7 Claims, 4 Drawing Figures

Figure 2:
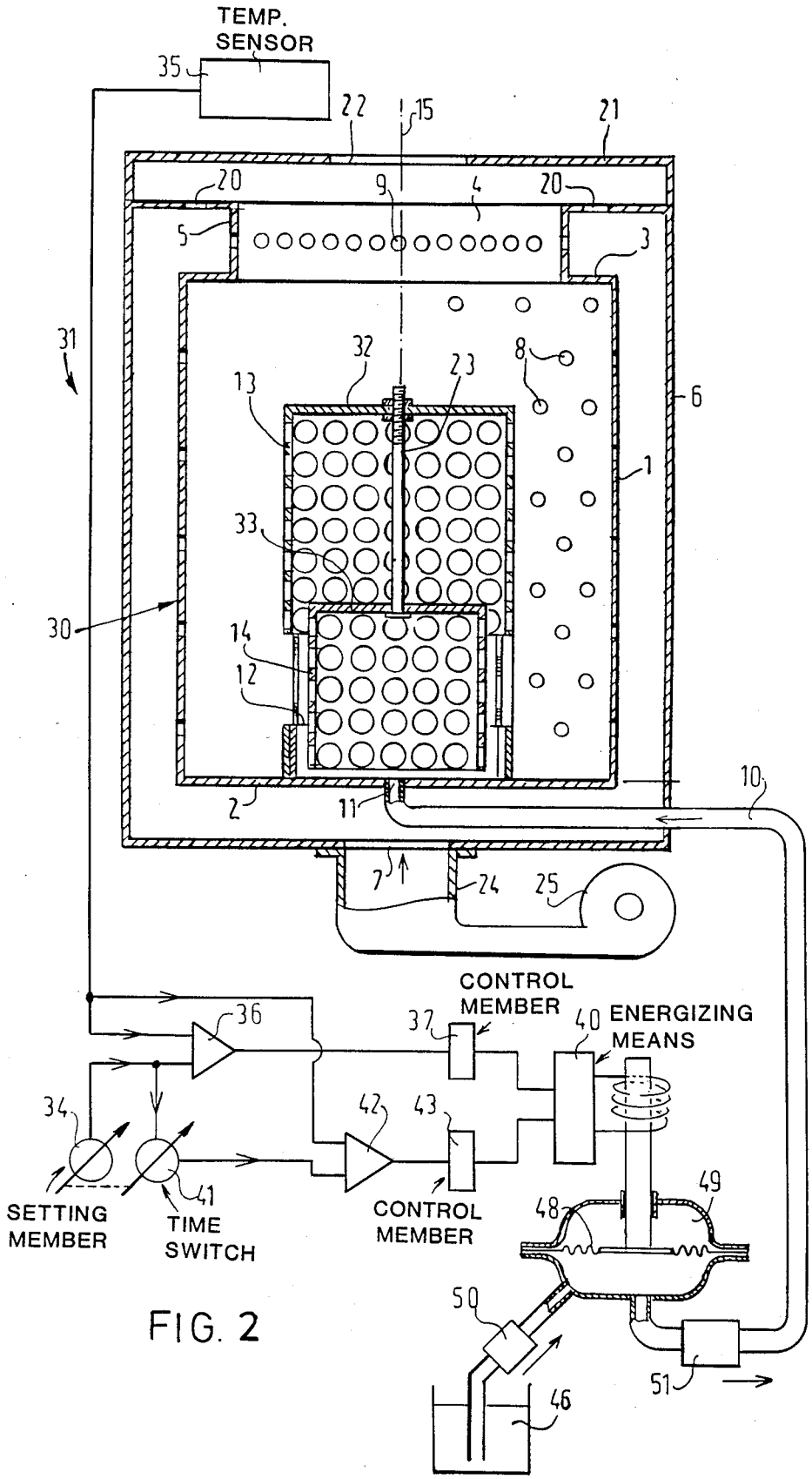

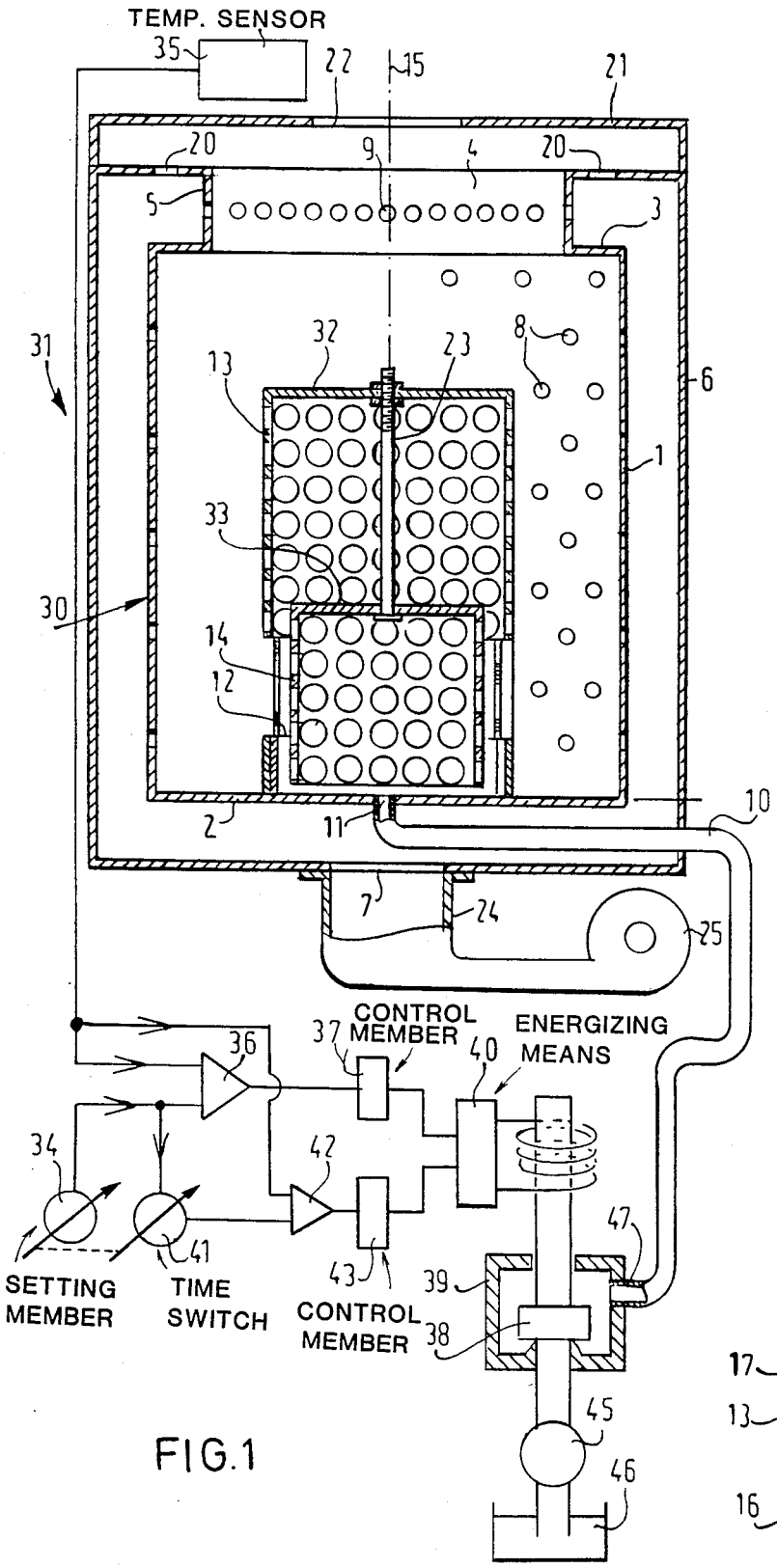
FIG.1
FIG.4
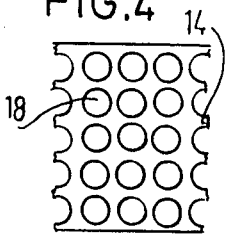
FIG.3
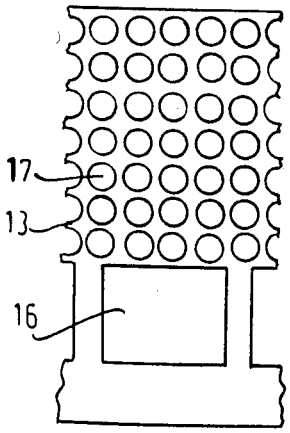

METHOD OF CONTROLLING THE FUEL SUPPLY AND BURNER FOR LIQUID FUEL

The invention relates to a method of controlling the liquid fuel to be supplied to a burner by conveying the liquid fuel through a control member, which is repeatedly energized with a set energizing time and a set frequency.

Such a method is known from FR.PS No. 1,326,126. According to this known method, the frequency and the energizing time are adjusted at the same time and together.

The invention provides an improved method, which is characterized in that the frequency and the energizing time are separately adjusted, that first the frequency is adjusted for obtaining a desired temperature and that a deflection between the temperature reached and the desired temperature is corrected by setting the energizing time. According to this known method the frequency is adjusted for obtaining the desired temperature starting from an expected heat contents of the liquid fuel. Some setting of the frequency may possibly occur for decreasing the deflection between the temperature obtained and the desired temperature in order to correct the deflection of the real heat contents with respect to the normal heat contents of the fuel per fuel unity.

At last the deflection between the temperature obtained and the desired temperature is corrected by adjusting the energizing time for correcting the inaccuracy in the quantity of fuel delivered by the control member, which inaccuracy is a result of the deflection of the fuel viscosity from an output viscosity.

The invention will be described more fully hereinafter with reference to a drawing in which:

FIGS. 1 and 2 are each a diagram for the method and the burner in accordance with two different embodiments, FIG. 3 is an exploded view of part of the sidewall of a first inverted cage, and FIG. 4 is an exploded view of part of the sidewall of a second inverted cage.

As shown in FIGS. 1 and 2 the pot 30 of a burner 31 comprises a cylindrical sidewall 1, a bottom 2 and a top wall 3, having a recess giving access to a flame orifice 4. The flame orifice 4 is bounded by an axially extending wall 5, which is at right angles to the top wall 3 of the pot 30.

The pot 30 is surrounded by a jacket 6, which joins the top edge of the wall 5 of the flame orifice 4 extending as far as beyond the pot bottom 2 and has, on the bottom side, an orifice 7 for an inlet conduit 24 of air forced in communicating with a fan 25. The air sucked in is driven upwards in the space between the wall 5 and the jacket 6 and is subsequently conducted away through apertures 8 dispersed along the height of the wall 5 into the pot 30 as primary air and respectively supplied through apertures 9 in the wall 5 of the flame orifice 4 as secondary air.

A duct 10 is provided for the supply of liquid fuel. The duct 10 is passed across the jacket 6 and opens into an opening 11 arranged centrally in the pot bottom 2.

Concentrically provided inside the pot 30 is a ring 12 of sheet steel, which is connected with the pot bottom 2. The ring 12 limits the surface of the pot bottom 2 to be wetted by the liquid fuel and concentrates the gasification process inside the space enclosed by the ring 12.

The outer surface of the ring 12 is snugly embraced by an inverted cage 13 having a closed top wall 32 and a perforated sidewall. Arranged concentrically inside the cage 13 is a second, inverted cage 14, the height of which is equal to about half the height of the cage 13. The second cage 14 has a closed top wall 33 and a perforated sidewall. The cage 14 is held in place by means of a suspension rod 23 in a manner such that the lower side of the sidewall extending inside the space confined by the ring and the pot bottom 2 without being in contact with the surface of the ring 12 and the pot bottom 2. The distance between the lower edge of the sidewall of the second cage 14 and the pot bottom 2 is such that under all operational conditions of the pot burner 31 the gasification of all fuel supplied is maintained, irrespective of deviations of the central axis 15 of the pot burner 31 from the vertical position occurring within given limits, provided the pot burner 31 is some time in operation and is sufficiently warmed up.

The two cages 13 and 14 are made from refractory material, particularly sheet steel. FIGS. 3 and 4 are exploded views of part of the sidewall of the first cage 13 and part of the sidewall of the second cage 14, respectively. From FIG. 3 it will be apparent, that the first cage 13 has near the lower side a row of apertures 16 of a first type, said apertures being substantially rectangular, above which a plurality of rows of apertures 17 of a second type are provided, which are substantially circular.

The passage area of each aperture 16 of the first type is larger than that of each aperture 17 of the second type. When the first cage 13 is disposed around the ring 12, the rectangular apertures 16 are bounded on the one hand by the top edge of the ring, whilst said apertures extend in the sidewall of the first cage 13 along a height, which is smaller than the distance between the top wall 33 of the enclosed second cage 14 and the pot bottom 2. The comparatively large, rectangular apertures 16 serve to admit the combustion air unhindered into the second cage 14. The comparatively small apertures 18 of the second cage are distributed throughout the entire sidewall thereof.

During the operation the liquid fuel admitted is gasified on the part of the pot bottom 2 inside the ring 12. Owing to the closed top walls of the two cages 13 and 14 the gas is driven sideways, in order to raise the temperature of the cages to an optimum value. The freely arranged cage 14 attains a temperature (about 700°) which is appreciably higher than the temperature (about 390°) of the pot bottom 2. The hot internal cage 14 serves to maintain the gasification of all fuel supplied, even if the pot burner is exposed to rocking movements, that is to say even when the pot bottom 2 moves out of its horizontal position.

Due to the great radiation heat resulting in a hot pot bottom 2, the fuel is almost immediately gasified. As a result the contact surface between the distributed liquid fuel and the pot bottom 2 is reduced and the liquid fuel, which in lifted position of the pot burner would tend to flow through the rectangular apertures 16 across the upper edge of the ring 12, is already gasified before being able to arrive at the ring 12 or to pass beyond said ring 12. The combustion air admitted through the comparatively large apertures 16 in the external cage 13 into the internal cage 14 generates small flames on the sidewalls of the two cages at the comparatively small apertures. These flames are maintained on the sidewall of the internal cage 14 by the external cage 13 when the pot burner 31 burns at higher capacity.

For increasing the capacity of the pot burner 31 a circular row of additional air apertures 20 is provided in the upper side of the jacket 6, whereas an additional screen 21 is arranged thereabove, said screen having a central orifice 22, the passage of which is considerably smaller than that of the flame orifice 4.

It has been found that diesel oil as a liquid fuel provides optimum results and that even in the case of rocking movements within given limits the pot burner 31 shows a quiet flame shape and ensures complete combustion in all positions of the control system described hereinafter.

The fuel control system as shown in FIGS. 1 and 2 comprises a setting member 34 for adjusting the desired temperature at the place of a thermometer 35. The temperature measured by the thermometer 35 is compared by means of a comparing device 36 with the set desired temperature of the setting member 34. The difference of these two temperatures is lead as an output signal from the comparing device 36 to a control member 37 for adjusting the energizing frequency of an electromagnetically driven valve 38. The control member 37 communicates with the energizing means 40 of said valve 38. The setting member 34 is mechanically coupled with a time switch 41, which connects the set desired temperature after an initial period of operation to a comparing device 42, which compares then the desired temperature with the temperature measured then by the thermometer 35. The output signal from the comparing device 42 adjusts a control member 43 which sets, independently from the control member 37 for adjusting the energizing frequency, the energizing time of opening the repeatedly energized valve 38 and which, as a result, is connected with the energizing means 40. The valve 38 is arranged in a valve housing 39, the inlet 44 of which communicates with a pump 45 pumping liquid fuel from a tank 45. The outlet 47 communicates with the duct 10.

The control system shown in FIG. 2 is equal to that of FIG. 1. However, in FIG. 2 the energizing means 40 energize a membrane 48 of a diaphragm pump 49, so that liquid fuel from a tank 46 is pumped through an inlet valve 50 and an outlet valve 51 and through the duct 10 to the burner 31.

What I claim is:

1. A method of controlling the supply of fuel to a burner so as to achieve a desired temperature of operation thereof, which comprises the steps of:

(a) pumping liquid fuel to the burner at an initial pulsed pumping rate which is of a set frequency and at a set duration during each cycle of said set frequency corresponding to an expected heat content and expected viscosity of the liquid fuel;

(b) maintaining said set duration of pumping during an initial period of time and varying the frequency of pumping from said set frequency during said initial period of time in response to deviation of the temperature of operation from said desired temperature of operation; and then (c) varying the duration of pumping during each cycle of the frequency of pumping attained in step (b) from said set duration of pumping in response to deviation of the temperature of operation from said desired temperature after said initial period of time, whereby said desired temperature of operation is attained despite deviation in heat content and viscosity of the fuel from said expected heat content and expected viscosity.

2. The method as defined in claim 1 wherein the variation of step (b) substantially compensates deviation of the heat content of the liquid fuel from said expected heat content, and the variation of step (c) substantially compensates deviation of the viscosity of the liquid fuel from said expected viscosity.

3. In combination with a burner having fuel supply means for supplying fuel to said burner at a variably controlled volumetric rate to produce a correspondingly variable heat output rate from the burner, comprising the combination of:

means for pumping a fuel to the burner at an initial volumetric rate determined by a set frequency of pumping and a set duration of pumping during each cycle of said set frequency of pumping so that said initial volumetric rate would produce a particular heat output rate if the fuel has an expected heat content and expected viscosity;

first control means connected with said means for pumping fuel for varying only the frequency of pumping from said set pumping frequency during an initial period of time to change said specified initial volumetric rate to an adjusted volumetric rate in response to deviation of the actual heat output rate from said particular heat output rate, said adjusted volumetric rate producing an adjusted heat output rate corrected toward said particular heat output rate; and second control means connected with said means for pumping fuel for varying said set duration of pumping to change said adjusted volumetric rate to a further adjusted volumetric rate in response to deviation of the adjusted heat output rate from said particular heat output rate, which further adjusted volumetric rate substantially produces said particular heat output rate so that said first and second means compensate for deviation of the fuel being burned from the expected heat content and expected viscosity.

4. In the combination as defined in claim 3 including time delay means for preventing operation of said second control means until after operation of said first control means.

5. In the combination as defined in claim 4 including temperature sensing means for controlling said first control means and said time delay means.

6. In the combination as defined in claim 3 including temperature sensing means for controlling said first control means and said second control means.

7. In the combination as defined in any one of claims 3–6 wherein said burner is of the pot type operated at a temperature sufficient to vaporize the fuel before it is burned.

* * * * *